US011097928B2

(12) United States Patent
King

(10) Patent No.: US 11,097,928 B2
(45) Date of Patent: Aug. 24, 2021

(54) WINCH ASSEMBLY

(71) Applicant: Transking Corporation Pty Limited, Wetherill Park (AU)

(72) Inventor: Lindsay Alexander King, North Rocks (AU)

( * ) Notice: Subject to any disclaimer, the term of this patent is extended or adjusted under 35 U.S.C. 154(b) by 138 days.

(21) Appl. No.: 16/380,038

(22) Filed: Apr. 10, 2019

(65) Prior Publication Data

US 2020/0010308 A1 Jan. 9, 2020

(30) Foreign Application Priority Data

Jul. 9, 2018 (AU) ..... 2018902483

(51) Int. Cl.
*B66D 1/14* (2006.01)
*B66D 1/04* (2006.01)

(52) U.S. Cl.
CPC ..... *B66D 1/14* (2013.01); *B66D 1/04* (2013.01); *B66D 2700/0116* (2013.01)

(58) Field of Classification Search
CPC .... B66D 1/04; B66D 1/06; B66D 1/14; B60P 7/0846; B60P 7/0853
See application file for complete search history.

(56) References Cited

U.S. PATENT DOCUMENTS 3,125,200 A * 3/1964 Kaman ..... B66D 3/22 477/182
3,541,888 A * 11/1970 Day ..... B66D 1/14 254/357
3,690,409 A * 9/1972 Brauss ..... B66D 1/14 182/142
3,848,889 A * 11/1974 Sharrow ..... B60P 7/083 410/103
4,823,443 A * 4/1989 Waters ..... A44B 11/125 24/68 CD
5,156,506 A * 10/1992 Bailey ..... B60P 3/41 24/68 CD
5,425,154 A * 6/1995 Edwards, Jr. ..... B60P 7/083 16/422
6,481,692 B1 * 11/2002 King ..... B60P 7/0853 254/219
7,108,246 B2 * 9/2006 Fortin ..... B60P 7/083 24/69 ST
7,216,849 B2 * 5/2007 Tremblay ..... B60P 7/083 24/69 ST (Continued)

FOREIGN PATENT DOCUMENTS

AU 200066493 4/2001

*Primary Examiner* — Emmanuel M Marcelo
(74) *Attorney, Agent, or Firm* — Scheef & Stone, LLP; Robin L. Barnes

(57) ABSTRACT

A winch assembly (50) including: a winch shaft (12) rotatably mounted within a bracket (18) and adapted for rotation about a first axis (68); a substantially right-angled drive transferring mechanism having a drive input coupled to a manual tool engagement device and drive output coupled to the winch shaft (12), the tool engagement device adapted for rotation about a second axis (72) extending substantially radially from the first axis (68), wherein manual rotation of the tool engagement device causes rotation of the winch shaft (12); and an anti-twist bar (64) attached to the bracket (18) to reduce twist during rotation of the winch shaft (12).

12 Claims, 6 Drawing Sheets

(56) References Cited

U.S. PATENT DOCUMENTS

| | | | | |
|---|---|---|---|---|
| 7,374,379 | B2 * | 5/2008 | Booher | B60P 7/083 410/100 |
| 7,556,240 | B1 * | 7/2009 | Bauer | B66D 1/14 254/294 |
| 8,967,332 | B2 * | 3/2015 | Wolner | A62B 35/0031 182/3 |
| 2017/0203680 | A1 * | 7/2017 | Mahaffey | F16G 11/12 |
| 2018/0290582 | A1 * | 10/2018 | Chou | B60P 7/0853 |
| 2020/0010308 | A1 * | 1/2020 | King | B66D 1/04 |

* cited by examiner

WINCH ASSEMBLY

FIELD OF THE INVENTION

The present invention relates to a winch assembly.

The invention has primarily developed for use in tensioning a load retaining strap for restraining freight of load on vehicles including rigid-bodied trucks, semi-trailers, flat-deck trailers, drop-deck trailers, car carriers and logging trailers and will be described with reference to these applications. However, it will be appreciated that the invention is not limited to these applications.

BACKGROUND OF THE INVENTION

The use of winches in applying tension to load retaining straps in the transport industry is well known. Known winches include a winch shaft mounted for rotation in a bracket that can be attached to, for example, a semi-trailer. Cylindrical extensions coupled to respective ends of the winch shaft are provided on either side of the bracket. The extensions include a radial aperture through which a drive bar or pole may be inserted to rotate the extension and thus the winch shaft.

The rotational axis of the winch shaft is generally substantially parallel to the longitudinal axis of the trailer and the cylindrical extension and the bar rotate about that axis. In recent times, it has become necessary to mount additional components to the trailers, for example mud guards. These components greatly restrict access to the cylindrical extension at certain locations along the length of the trailer and can make rotation by the bar or pole difficult impossible.

AU 200066493 provides a winch assembly intended for use in confined or restricted spaces. Whilst the winch assembly ameliorates some of the deficiencies, high strap tension may cause binding and excessive wear to the system. Over time this may lead to gear slippage.

OBJECT OF THE INVENTION

It is an object of the present invention to substantially overcome or at least ameliorate this deficiency.

SUMMARY OF THE INVENTION

Accordingly, the present invention provides a winch assembly including:

a winch shaft rotatably mounted within a bracket and adapted for rotation about a first axis;

a substantially right-angled drive transferring mechanism having a drive input coupled to a manual tool engagement device and drive output coupled to the winch shaft, the tool engagement device adapted for rotation about a second axis extending substantially radially from the first axis, wherein manual rotation of the tool engagement device causes rotation of the winch shaft; and an anti-twist bar attached to the bracket to reduce twist during rotation of the winch shaft.

Preferably, the bracket is adapted to be slidably received within complimentary mounting formations on a vehicle or vehicle trailer.

Preferably, the bracket is adapted to be attached directly to a vehicle or vehicle trailer. In another form, the bracket is attached directly to the vehicle a vehicle trailer, for example by welding.

Preferably, the drive transferring mechanism includes a housing that contains a relatively small gear coupled to the tool engagement device that meshes with a relatively large gear coupled to the winch shaft.

Still preferably, the housing includes a projection configured for engagement with a grease gun for injecting grease within the housing.

Preferably, the drive transferring mechanism includes one or more bearings to reduce friction during rotation of the winch shaft.

Preferably, the one or more bearings includes bushing disposed on the winch shaft.

Preferably, the one or more bearings includes at least one bushing disposed on the drive input.

Another embodiment of the present invention provides a bi-fold handle for use with the winch assembly of any one of the preceding claims, the handle including:

a first portion having a first axis, the first portion configured to engage the drive transferring mechanism;

a second portion having a second axis generally perpendicular to the first axis; and a third portion pivotably attached at one end to the second portion, wherein the second portion includes a locking means configured to lock the third portion coaxial to the second portion.

Preferably, the locking means includes a locking sleeve and biasing means configured to urge the locking sleeve in engagement with the second portion.

Preferably, the first portion and the second portion are one piece.

The third portion may include a rotatable sleeve, or a non-sleeved straight bar handle.

Preferably, the bracket is configured to be attached directly to a vehicle or vehicle trailer. In another form, the bracket is attached directly to the vehicle a vehicle trailer, for example by welding.

The drive transferring mechanism is preferably contained in a housing. In one form, the housing is fixed relative to the mounting bracket. In another form, the housing is rotatable about the first axis relative to the bracket.

The housing is desirably positioned adjacent one end of the winch shaft and a cylindrical extension with a radial aperture therethrough is desirably positioned adjacent the other end of the winch shaft.

The drive transferring apparatus preferably includes a relatively small gear coupled to the tool engagement device that meshes with a relatively large gear coupled to the winch shaft. The gears are preferably helical bevel gears.

The winch shaft preferably includes means for engaging a load retaining strap, most preferably in the form of a slot.

BRIEF DESCRIPTION OF THE DRAWINGS

Preferred embodiments of the invention will now be described, by way of examples only, with reference to the accompanying drawings in which.

DETAILED DESCRIPTION OF THE PREFERRED EMBODIMENTS

Figure 1:
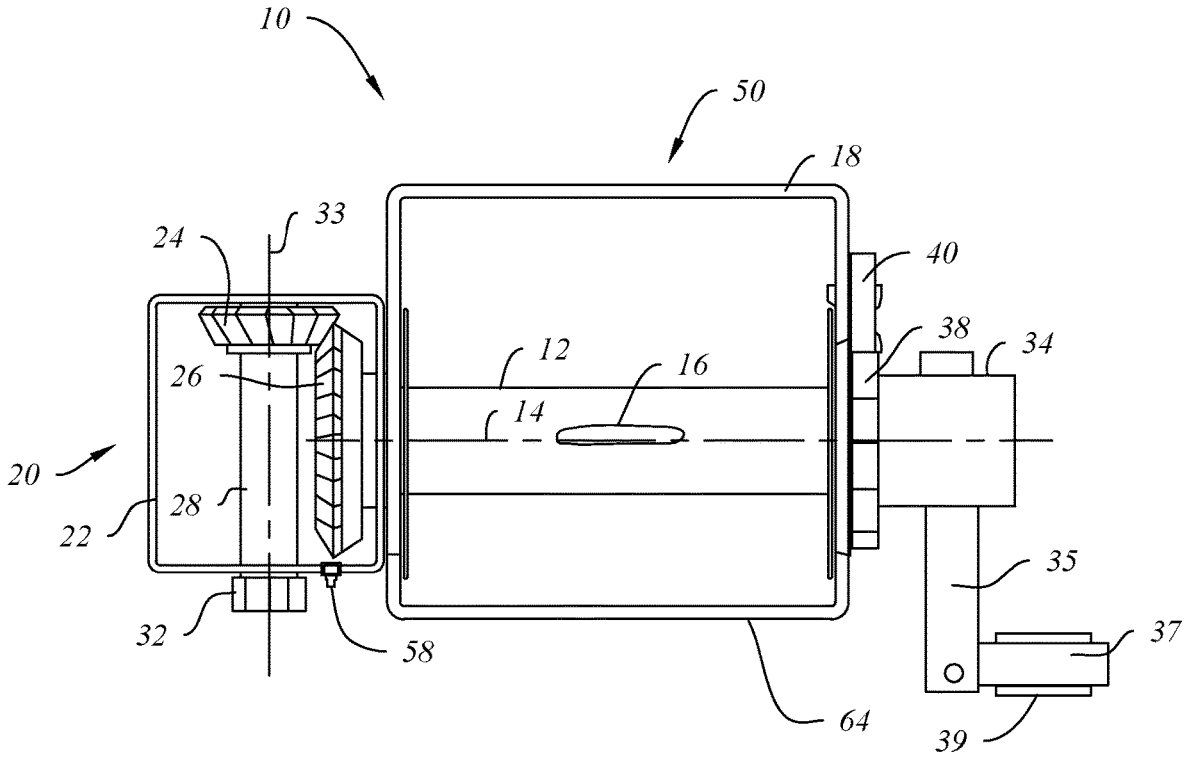
FIG. 1 shows a side view of winch assembly in accordance with an embodiment of the present invention.

Referring to FIG. 1, there is shown a winch assembly 10 in accordance with an embodiment of the present invention.

The winch assembly 10 includes a shaft 12 which is adapted for rotation about a first axis 14. The shaft 12 includes a slot 16 for engagement with a load retaining strap (not shown), as well known in the art. The shaft 12 is rotatably mounted within a bracket 18. An anti-twist bar 64 is welded or bolted to the bracket 18. The anti-twist bar 64 reduces twist and distortion to the bracket 18 during winding thus enabling a high tension to be achieved. The bracket 18 can be adapted to slidably engage winch track rails provided on, for example, a semi-trailer. Alternatively, the bracket 18 can be attached directly to the trailer, for example, by welding.

A right-angled drive transferring mechanism, indicated generally by the reference numeral 20, is mounted external to the bracket 18 adjacent one end of the shaft 12. The mechanism 20 includes a housing 22 that contains a relatively small input drive gear 24 positioned in meshing engagement with a relatively large output drive gear 26. The input drive gear 24 is non-rotatably mounted on an input shaft 28. A tool engagement device, in the form of a nut 32, is also non-rotatably mounted on the shaft 28 external house 22. The nut 32, shaft 28 and gear 24 are adapted for rotation about axis 33 which extends radially from the axis 14.

In this embodiment, the housing 22 is adapted to rotate about the axis 14 relative to the bracket 18 for convenient positioning of the drive nut 32 by the operator. However, in other embodiments (not shown), the position of the housing 22 may be fixed relative to the housing 18.

The output gear 26 is non-rotatably mounted directly to one end of the shaft 12. A cylindrical extension 34 with a radial aperture therein is non-rotatably mounted to the shaft 12 adjacent the other end of the shaft 12. A toothed locking wheel 38 is non-rotatably mounted to the extension 34 for engagement with a ratchet locking member 40. Engaging the locking member 40 with the gear 38 locks the shaft 12 at a predetermined position as is well known in the art.

A straight bar 35 may be used in conjunction with the cylindrical extension 34 for winding/tightening of the strap (not shown). A small handle 37 with a rotating sleeve 39 is attached to the straight bar 35 for ease of winding the strap before tightening.

A projection 58 in the form of a grease nipple is configured for engagement with a grease gun for injecting grease within the housing 22. The grease nipple 58 allows for addition of lubricant without opening the housing 22 thus facilitating ease of service.

Figure 2:
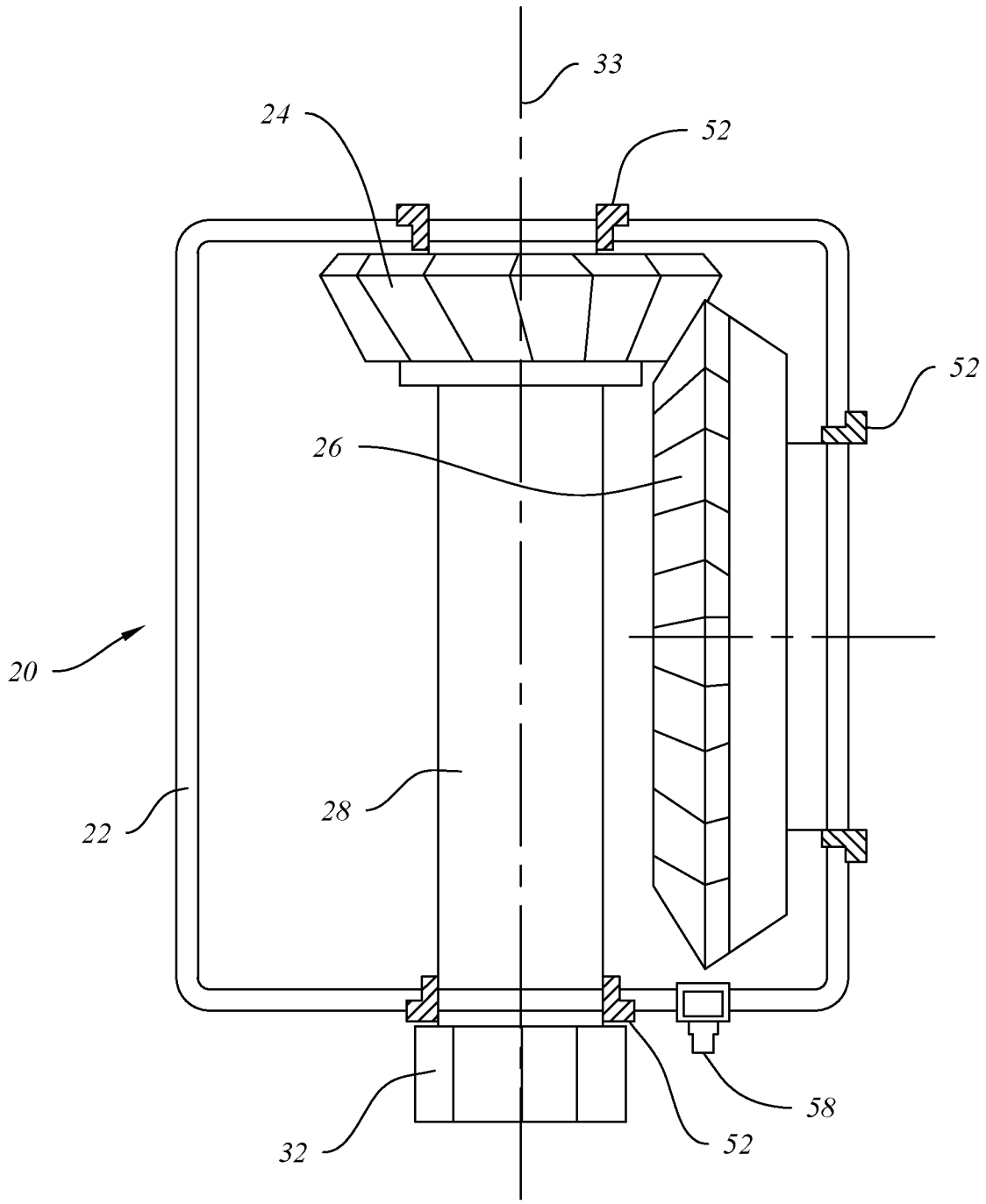
FIGS. 2-3 show partial side views of the winch assembly in FIG. 1.
Figure 3:
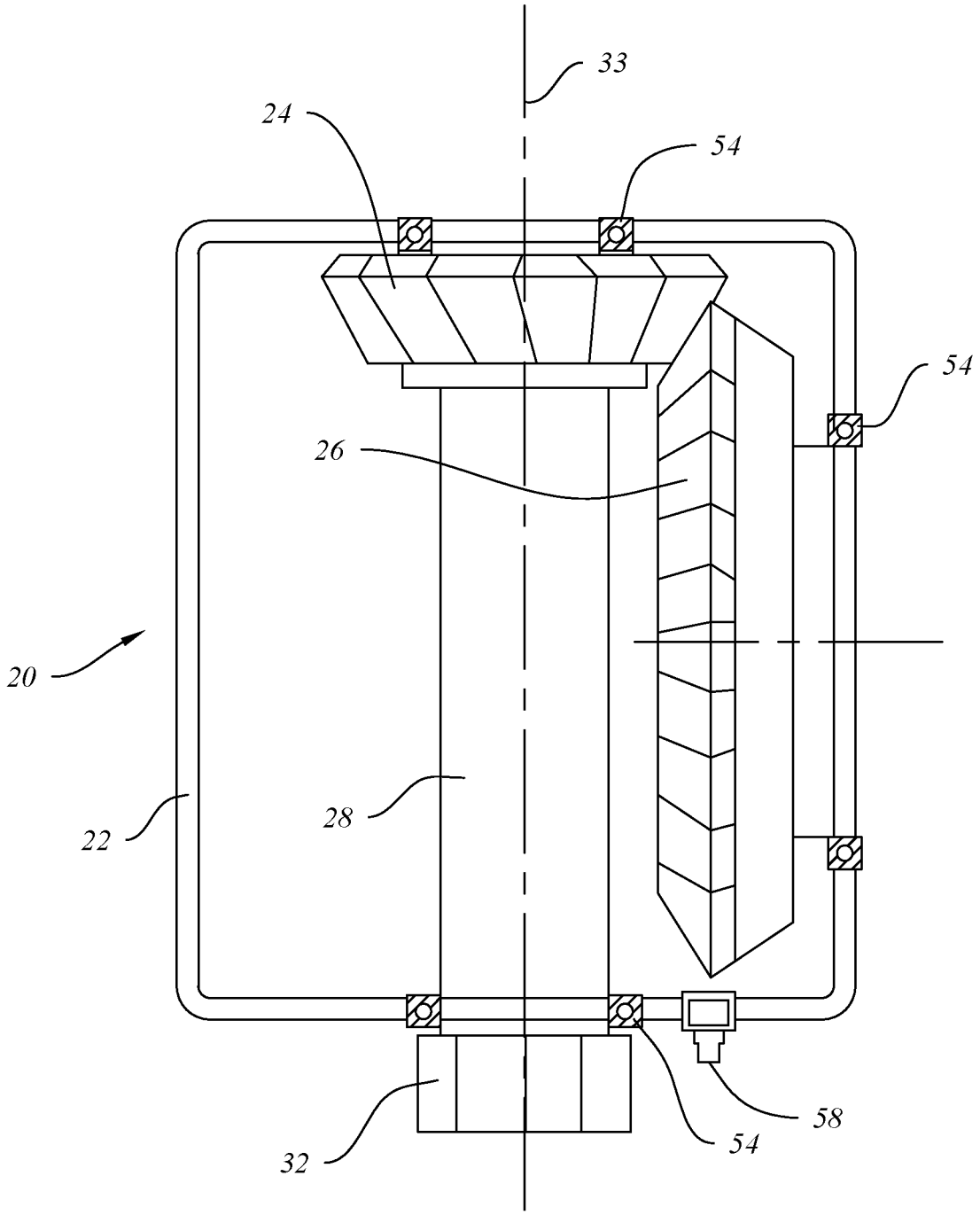
Figure 4:
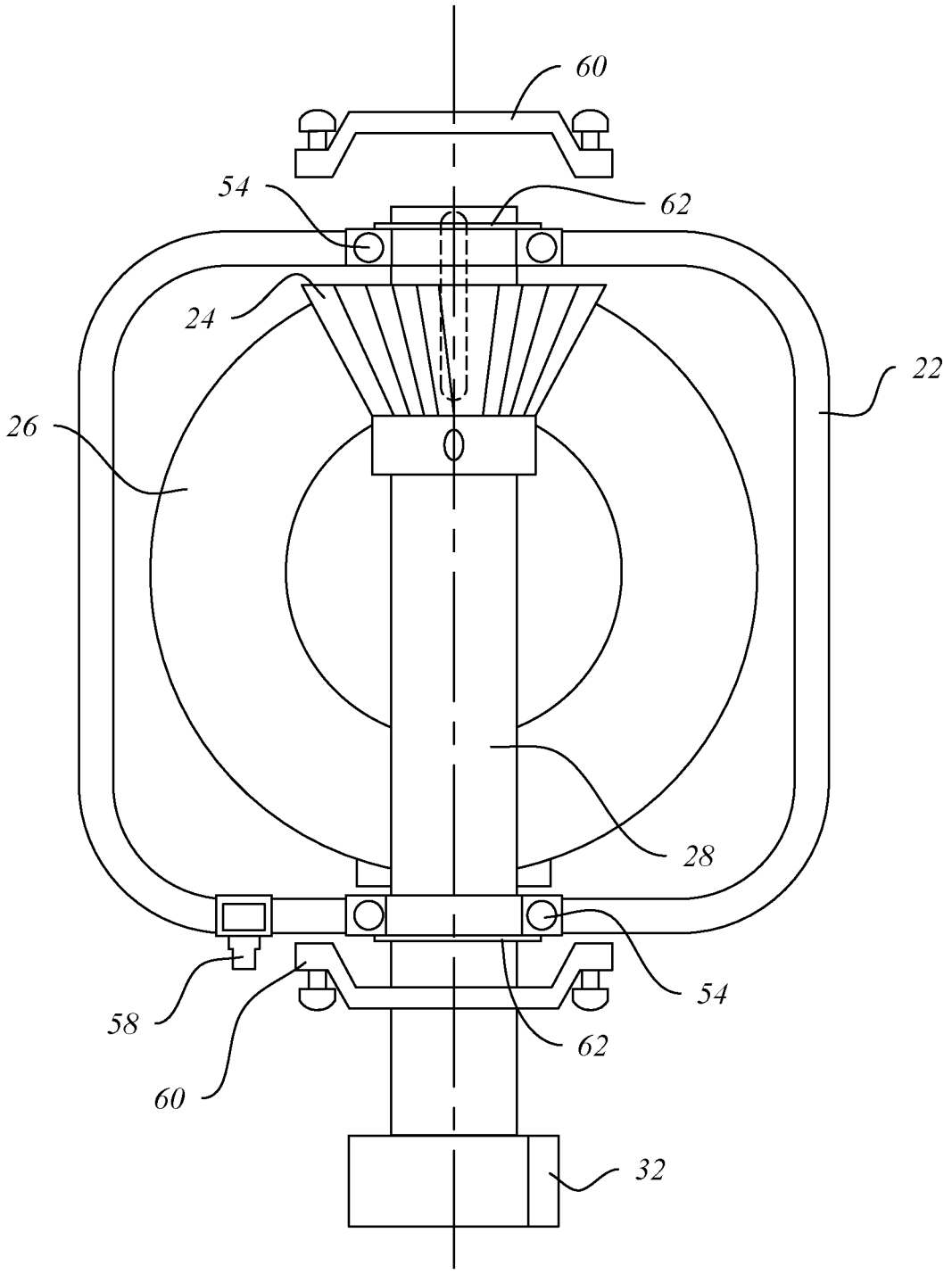
FIG. 4 shows an end view of the winch assembly in claim 1.

As shown in FIGS. 2, 3 and 4 the winch shaft 12 and the drive shaft 28 each include bearings to reduce friction during operation. In FIG. 2, the shafts 12, 28 have bushings 52. The bushings can be bronze or neoprene or other suitable material. In FIGS. 3 and 4, the shafts 12, 28 have ball bearings 54. The ball bearings 54 are held in place using a circlip 62 and end cap 60. The addition of bearings (such as ball bearings, roller bearings, bushings, or circlips) prevents the shafts 12, 28 from contacting the housing 22. This reduces friction throughout the system and enables a higher tension on the strap at less input.

Figure 5:
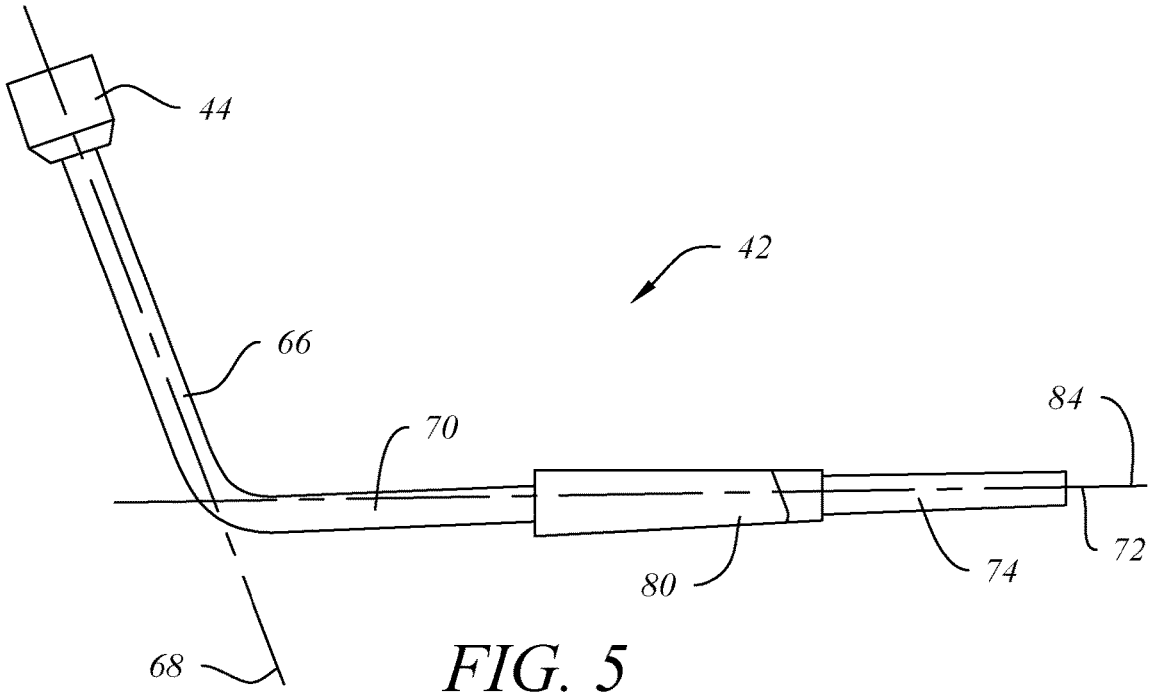
FIGS. 5-7 show a tool suitable for use with the winch assembly.
Figure 6:
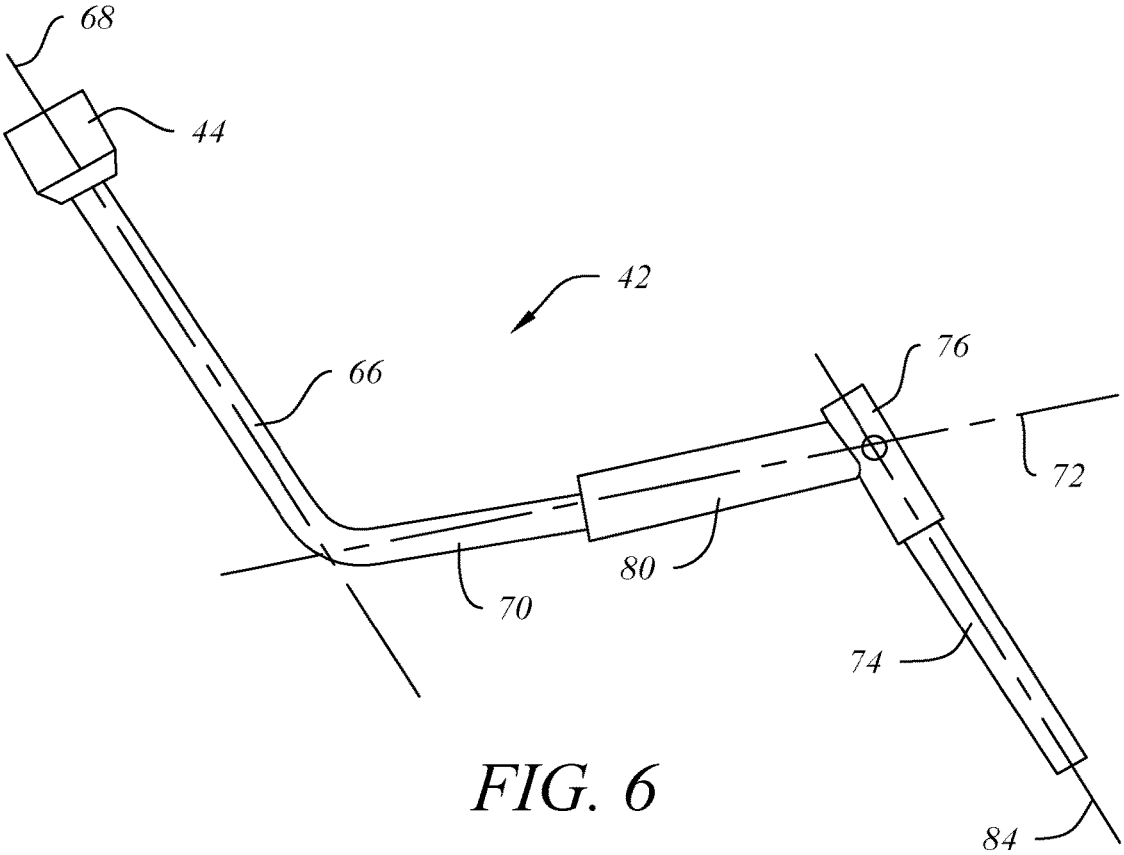
Figure 7:
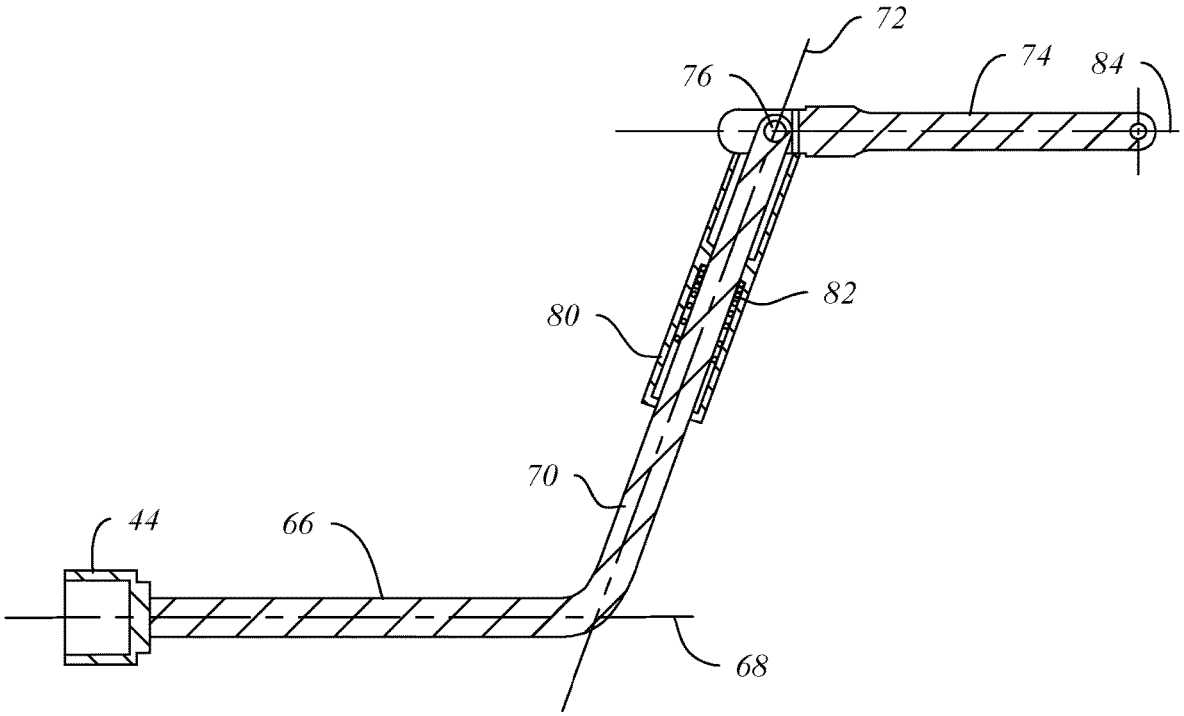

FIGS. 5-7 show a tool in the form of a self-locking bi-fold handle 42 for tensioning the winch assembly 10. The bi-fold handle 42 acts as a crank handle while taking up loose strap and obtaining light tension. The bi-fold handle 42 has a socket 44 on one end adapted to engage the nut 32. The bi-fold handle 42 includes a first portion 66 having a first axis 68 and a second portion 70 having a second axis 72 generally perpendicular to the first axis 68. The first and second portions 66, 70 are fixed relative to each other. Preferably, the first and second portions 66, 70 are a single piece such as a steel rod. A locking sleeve 80 is positioned around the second portion 70 of the bi-fold handle 42. The locking sleeve 80 houses a spring mechanism 82 (shown in FIG. 7). A third portion 74, having a third axis 84 is pivotably attached at one end 76 to the second portion 70 and is pivotable between a straight position in which the second and third portions 70, 74 are coaxial (FIG. 5) and a bent position in which the second and third portions 70, 74 form an angle of 90 degrees or greater (FIGS. 6 and 7). In the straight position the spring mechanism 82 urges the locking sleeve 80 upward toward the pivot 76, locking the third portion 74 generally coaxially with the second portion 70. In this configuration (FIG. 5) it is possible to achieve high tension on the shaft 28. The bi-fold handle 42 can be unlocked by moving the locking sleeve 80 away from pivot 76 and releasing the third portion 74 (see FIGS. 6 and 7). The bi-fold handle 42 includes a rotatable sleeve 74 for ease of winding before tightening. It will be understood that the bi-fold handle 42 may alternatively include a non-sleeved straight bar handle.

The primary advantage of the invention is that it can be mounted within confined spaces as only access to the nut in the direction of its rotational axis is required. The self-locking bi-fold handle enables easy access in low ground clearance during tightening of the strap, such as operating the winch in a double drop-deck trailer configuration. Additionally, the anti-twist bar reduces twisting and distortions to the bracket when operating, allowing further tension to be obtained when operating. Finally, the bearings and bushings prevent the drive shaft from binding when endeavoring to obtain high strap tension, which can result in excessive wear to the gear box housing and the drive shaft, and over time, cause gear slippage.

Although the invention has been described with reference to specific examples, it will be appreciated by those skilled in the art, that the invention may be embodied in many other forms.

The invention claimed is:

1. A winch assembly including:

a winch shaft rotatably mounted within a bracket and adapted for rotation about a first axis;

a substantially right-angled drive transferring mechanism having a drive input coupled to a manual tool engagement device and drive output coupled to the winch shaft, the tool engagement device adapted for rotation about a second axis extending substantially radially from the first axis, wherein manual rotation of the tool engagement device causes rotation of the winch shaft; and a bi-fold handle for use with the winch assembly, the handle including:

a first portion having a first axis, the first portion configured to engage the drive transferring mechanism;

a second portion having a second axis generally perpendicular to the first axis; and a third portion pivotably attached at one end to the second portion, wherein the second portion includes a locking means configured to lock the third portion coaxial to the second portion.

2. The winch assembly of claim 1, wherein the bracket is adapted to be slidably received within complimentary mounting formations on a vehicle or vehicle trailer.

3. The winch assembly of claim 1, wherein the bracket is adapted to be attached directly to a vehicle or vehicle trailer.

4. The winch assembly of claim 1, wherein the drive transferring mechanism includes a housing that contains a relatively small gear coupled to the tool engagement device that meshes with a relatively large gear coupled to the winch shaft.

5. The winch assembly of claim 4, wherein the housing includes a projection configured for engagement with a grease gun for injecting grease within the housing.

6. The winch assembly of claim 1, wherein the drive transferring mechanism includes one or more bearings to reduce friction during rotation of the winch shaft.

7. The winch assembly of claim 6, wherein the one or more bearings includes at least one bushing disposed on the winch shaft.

8. The winch assembly of claim 7, wherein the one or more bearings includes at least one bushing disposed on the drive input.

9. The winch assembly of claim 1, wherein the locking means of the bi-fold handle includes a locking sleeve and biasing means configured to urge the locking sleeve in engagement with the second portion.

10. The winch assembly of claim 1, wherein the first portion and the second portion of the bi-fold handle are one piece.

11. The winch assembly of claim 10, wherein the third portion of the bi-fold handle includes a rotatable sleeve.

12. The winch assembly of claim 1, including an anti-twist bar attached to the bracket to reduce twist during rotation of the winch shaft.

* * * * *